United States Patent [19]

DeBurgh

[11] 4,091,476

[45] May 30, 1978

[54] PORTABLE MALE URINAL

[76] Inventor: Ray DeBurgh, 1141 Laverne Way, Palm Springs, Calif. 92262

[21] Appl. No.: 510,056

[22] Filed: Sep. 27, 1974

[51] Int. Cl.[2] ..... A47K 11/00; A61G 9/00

[52] U.S. Cl. ..... 4/144.3

[58] Field of Search ..... 4/110–113; 128/292, 295; D23/68

[56] References Cited

U.S. PATENT DOCUMENTS

| | | | |
|---|---|---|---|
| 1,767,240 | 6/1930 | Ivory et al. | 4/113.1 |
| 2,084,788 | 6/1937 | Anderson | 4/110 UX |
| 2,750,600 | 6/1956 | MacDonald | 4/113 |
| 2,855,608 | 10/1958 | Painter | 4/112 X |
| 3,163,869 | 1/1965 | Johnson et al. | 4/110 |
| 3,415,299 | 12/1968 | Hinman et al. | 4/110 X |
| 3,604,424 | 9/1971 | Windom | 128/295 |
| 3,725,962 | 4/1973 | Gouget | 4/110 |

*Primary Examiner*—Richard E. Aegerter
*Assistant Examiner*—Stuart S. Levy
*Attorney, Agent, or Firm*—Larson, Taylor & Hinds

[57] ABSTRACT

A urinal is provided which includes an elongated container having concave sides that conform to the general shape of the user's thighs. The container includes a frontal orifice for receiving the male organ of the user and an internal tube, which slants downward from the frontal orifice, which serves to prevent spillage. The container also includes an outflow pipe and an associated valve used to empty the container. An undersheet is detachably secured to the bottom of the container and extends rearward of the container and outboard of the sides thereof, under the legs of the user, so as to secure the container in place while in use.

3 Claims, 4 Drawing Figures

PORTABLE MALE URINAL

FIELD OF THE INVENTION

This invention relates to a urinal and in particular to a portable male urinal adapted for use in bed, in a wheelchair or the like.

DESCRIPTION OF PRIOR ART

Examples of prior art in the field of portable urinals are disclosed in U.S. Pat. Nos. 2,084,788 (Anderson), 2,182,524 (Farrell), and 807,750 (LeLande).

The Anderson patent discloses a container which is shaped to conform to the inner thighs and crotch of the user. The container includes a large opening through which the urine enters and an inner wall or flange which prevents back flow of urine while in use. The urinal also has an under-buttock extension which keeps the urinal in place while being used. Among the major disadvantages of the urinal disclosed in the Anderson patent is the problem of spillage, the flange referred to above being inadequate for this purpose under all use conditions with the enlarged opening adding to the problem. Further, the under-buttock extension causes discomfort if used over extended periods of time.

The Farrell patent discloses a bottle-type urinal made of a flexible material such as rubber. The bottle had an apron designed to grip the abdomen and buttocks while in use and a flared skirt which provides a sealing effect to prevent leaks while the device is in use. In order to maintain the seal between the flared skirt and the body of the user, the device must be held in place by the user through hand grips, and apart from being cumbersome, this can present spillage problems.

The LeLande patent discloses a urinal device which is sat upon or layed upon and is not adapted for use by a male.

SUMMARY OF THE INVENTION

This invention relates to a novel portable urinal which is particularly useful in bed, a wheelchair or an easy chair over extended periods of time. According to a presently preferred embodiment thereof, the invention comprises an elongated container having concave sides generally conforming to the shape of the inner thighs of a user. The top of the container is closed while the bottom is shaped so that the container can sit in an upright position on a bed, chair or other support surface. The front portion of the container has a round orifice in which the organ of the user is inserted. Connected to the frontal orifice and contained within the container is a urine entrance tube, the tube slanting downwardly from the orifice towards the rear of the container. A flexible undersheet is detachably secured to the urinal and, in use, is positioned underneath the body of the user.

The urinal of the invention provides a number of important advantages. For example, the shape of the container is such that the container fits comfortably between the thighs of the user, which allows the urinal to be used for extended periods of time without discomfort. The provision of the urine entrance tube discussed above, overcomes the problem of accidental spillage of urine, the tube being slanted downward with the end disposed inside the container and being located above the liquid storage level of the container. The tube is preferably tapered to a smaller diameter at the internal end thus further reducing the possibilities of urine flowing out the frontal orifice of the container. In addition, the flexible undersheet, which fits under the body of the user, securely anchors the urinal in place while in use.

Other features and objects of the present invention will be set forth in or apparent from the detailed description of a preferred embodiment found hereinbelow.

DESCRIPTION OF THE PREFERRED EMBODIMENTS

Figure 1:
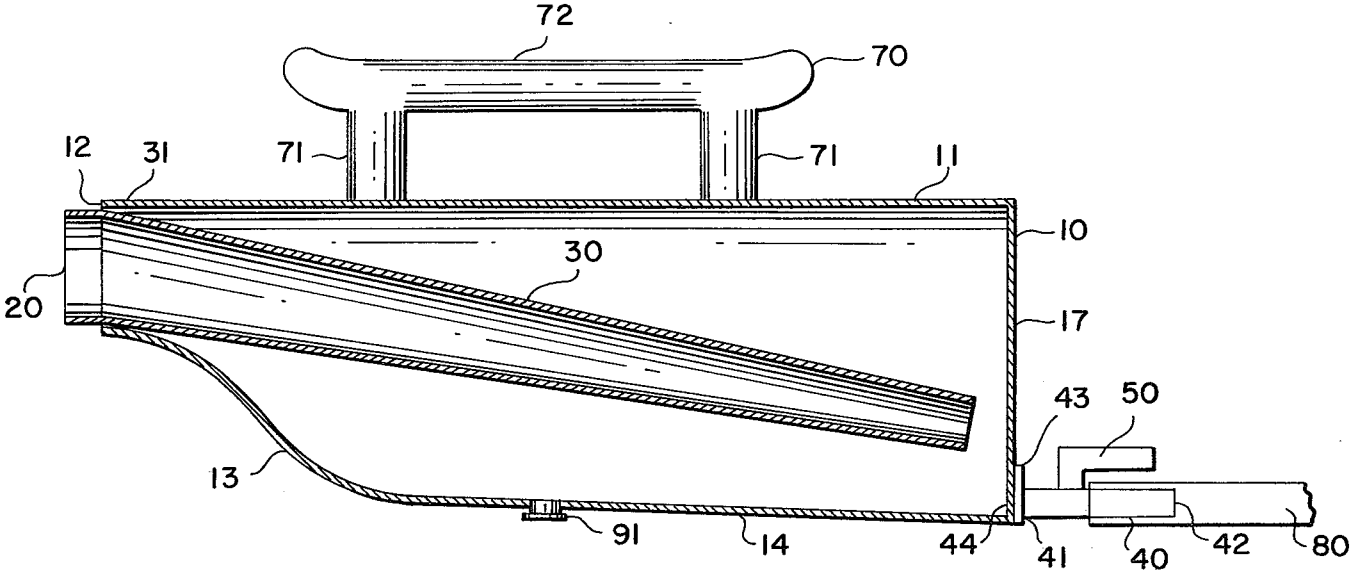
FIG. 1 is a cross sectional side elevational view of one embodiment of the invention.

Referring to the drawings, a urinal in accordance with the invention includes the following basic components: a container 10, a front orifice 20, a urine entrance tube 30, an outflow pipe 40, a outflow valve 50, a detachable undersheet 60, and a handle 70, all of which are described in more detail hereinbelow.

Figure 2:
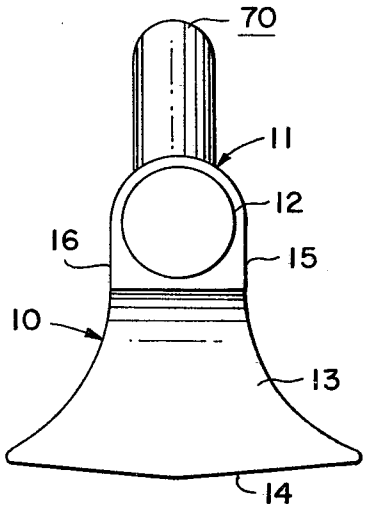
FIG. 2 is a frontal elevational view in accordance with the invention.
Figure 3:
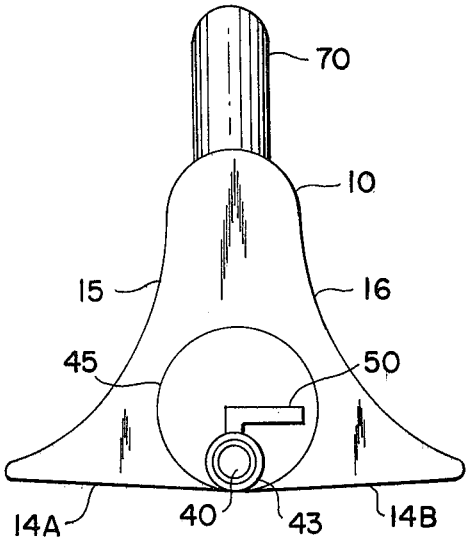
FIG. 3 is a rear elevational view of the urinal shown in FIG. 1.
Figure 4:
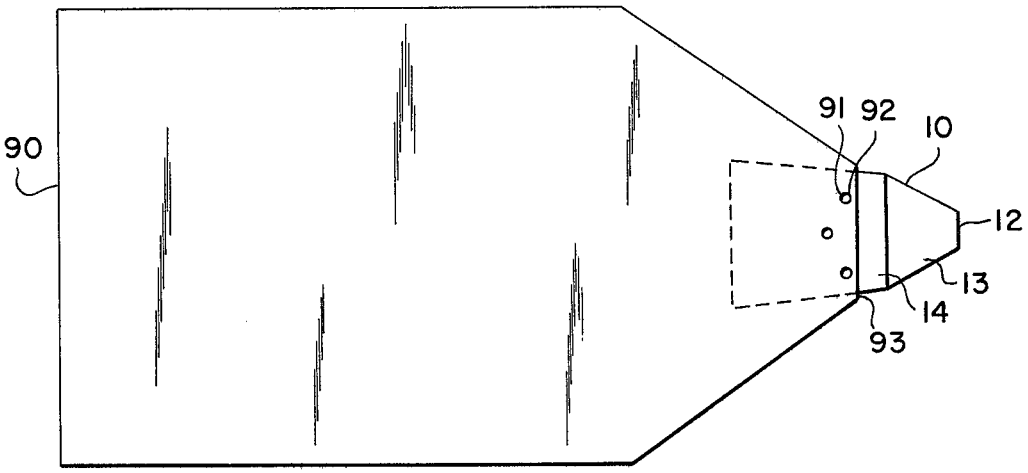
FIG. 4 is a bottom plan view of a urinal and an attached undersheet in accordance with the invention.

The general shape of the container 10 is shown in FIGS. 1 to 3. The container 10 is of elongated form and includes a rounded top 11, a front end portion 12, a first bottom portion 14, and a further curvilinear bottom portion 13 which extends between the front portion 12 and the bottom portion 14. Bottom portion 14 preferably includes panels 14A and 14B which are slanted towards the center and slanted downwardly towards the back portions 17 to facilitate drainage, however bottom 14 could also be made flat. A back portion 17 extends vertically from the bottom portion 14 as shown. The container further includes concave sides 15 and 16 which conform to the shape of the inner thighs of a user. The body of the container 10 is longitudinally tapered so that the front portion of the container 10 has a narrower cross section than the back. Container 10 is preferably fabricated from an autoclavable, translucent material such as an acrylic or other suitable plastic or an unbreakable glass. The container 10 could also be made of a suitable flexible material. The front end portion 12 of container 10 includes a frontal orifice 20 having a diameter such as will permit a comfortable introduction of the male organ of the user. The frontal orifice 20 communicates with the urine entrance tube 30 mentioned above.

The urine entrance tube 30 has a front end 31, tapered sides, and a distal end 32 having a smaller diameter than front end 31. The forward end 31 of the tube 30 is connected to the frontal orifice 20 and the tube 30 slants downward inside the container 10 towards the back end thereof, as shown. As mentioned above, the taper and downward slant of the tube 30 helps prevent the accidental spillage of urine through the frontal orifice 20. The urine entrance tube 30 can be made with a threaded end to attach to frontal orifice 20 for disassembly and cleaning. The tube 30 can be made of a flexible, autoclavable plastic material.

Drainage tube 40 is attached to an outlet orifice 41 in the back portion 17 of container 10. A washer 43 forms a water tight seal between drainage tube 40 and the container 10. Washer 43, for example, can be made from neoprene or other suitable materials. A metal reinforcing plate 45 is embedded into the back wall 17 to strengthen the mounting of the drainage tube 40 on the container 10.

Valve 50 is installed in the drainage tube 40 so as to permit the emptying of container 10.

Handle 70, which is attached to the rounded top 11 of container 10, is shaped for strength and ease of handling as well as for use as a reel for plastic drain tubing 80 described hereinbelow. The handle comprises two vertical support members 71 and a horizontal cross bar 72, the ends of which extend outboard of the vertical support members 71 as shown.

To provide use of the urinal as a catheter, a rubber extension tube 80 can be attached to the distal end of drainage tube 40 to enable the container 10 to be emptied into a larger remote container when the urinal is used for extended periods. The extension tube 80 is attached to the drainage tube 40 in a water tight relationship and can be, as stated, wrapped around the handle 70 when not in use. It will be appreciated that the urinal can be more safely and comfortably used than a conventional catheter tube, the urinal serving, for example, to prevent infections that may travel up a conventional catheter tube.

An undersheet 90 is provided which is used to anchor the urinal in place while in use. The tapered front portion of undersheet 90 is detachably secured to container 10 using suitable means such as snaps. In the examplary embodiment under consideration, the undersheet 90 is attached to the container 10 by means of a female snap receptical 92 located in the undersheet 90 and a male snap member 91 located on the bottom portion 14 of container 10. Other methods of attachment such as buttons, could also be used. The undersheet 90 extends rearwards of the container 10 and outboard of the sides of the container 10 and is of such a size as to fit under the body of the user to secure the urinal in place while in use. The undersheet can be made of muslin, a polymeric material, or other flexible material.

To prepare for use, the urinal is placed between the thighs of the patient or other user, and the sheet 90 is disposed beneath him. The concave sides 15 and 16, conforming to the shape of the thighs, allow for comfortable placement of the urinal. In use, the male organ is inserted in the frontal orifice 20 and the urine flows through frontal orifice 20, down the urine entrance tube 30 and into container 10 for storage. The downward slant of the urine entrance tube both aids in facilitating urine flow and, as stated, helps to prevent any accidental spilling. When urination is completed, the urinal container 10 is picked up by the handle 70 and emptied through the drain tube 40 by opening the valve 50. The urinal can then be flushed out or cleaned by other methods. The entrance tube 30 is preferably screwed into orifice 20 so as tube 30 can be readily removed and cleaned separately from container 10 where drainage tube 40 and associated valve 50 are not used.

Although the invention has been described in detail with respect to an exemplary embodiment thereof, it will be understood by those of ordinary skill in the art that variations and modifications may be effected within the scope and spirit of this invention.

I claim:

1. A portable male urinal comprising an elongate container, said container including a front having an orifice therein for receiving the male organ of a user, a back, a top, a bottom, and two concave sides, each said side curving outwardly between the top and the bottom so as to form an outwardly extending flange with said bottom whereby the shape of the sides generally conforms to the shape of the thighs of a user, each said flange being tapered along the length thereof from said back to said front so that said container fits comfortably between the thighs of the user thereby permitting extended use of said urinal over long periods of time without discomfort and further comprising an outlet tube disposed in said back at a location adjacent to said bottom and in communication with the interior of said container; valve means in said outlet tube for controlling the discharge of said outlet tube, said outlet tube having a means at the end thereof for connection with a length of flexible tubing; and a handle located on said top, said handle including first and second spaced vertical support members and a horizontal cross bar member extending beyond said first and second support members whereby the length of flexible tubing connectable to said outlet tube can be wrapped about said handle.

2. A portable male urinal comprising an elongate container, said container including a front having an orifice therein for receiving the male organ of a user, a back, a top, a bottom, and two concave sides, each said side curving outwardly between the top and bottom so as to form an outwardly extending flange with said bottom whereby the shape of the sides generally conforms to the shape of the thighs of a user, each said flange being tapered along the length thereof from said back to said front so that said container fits comfortably between the thighs of the user thereby permitting extended use of said urinal over long periods of time without discomfort, and further comprising in combination therewith a flexible sheet detachably secured to said bottom of said container, said sheet extending beyond said bottom at said sides and at said back length having dimensions so as to extend under the legs of the user, thereby permitting the legs of the user to secure said container in place while in use.

3. A portable male urinal as claimed in claim 2 and further comprising snap means for detachably securing said container to said flexible sheet.

* * * * *